US007007325B1

(12) United States Patent
Gomeh

(10) Patent No.: US 7,007,325 B1
(45) Date of Patent: Mar. 7, 2006

(54) METHOD FOR FITTING BEDDING TO A MATTRESS

(76) Inventor: Ram Gomeh, Simtat HaDror 6/1, Kfar Saba (IL) 44284

( * ) Notice: Subject to any disclaimer, the term of this patent is extended or adjusted under 35 U.S.C. 154(b) by 0 days.

(21) Appl. No.: 10/941,024

(22) Filed: Sep. 15, 2004

(51) Int. Cl.
*A47G 9/02* (2006.01)

(52) U.S. Cl. ..... 5/496; 5/498; 5/499; 5/923

(58) Field of Classification Search ..... 5/692, 5/494, 496, 498, 499, 923
See application file for complete search history.

(56) References Cited

U.S. PATENT DOCUMENTS 3,530,487 A * 9/1970 Beer ..... 5/496
4,488,323 A * 12/1984 Colburn ..... 5/692
4,979,251 A * 12/1990 Lazar ..... 5/496
5,666,680 A * 9/1997 Hackett, Jr. ..... 5/692
6,098,219 A * 8/2000 Milber ..... 5/494
6,886,197 B1 * 5/2005 Madigan ..... 5/482

* cited by examiner

*Primary Examiner*—Michael Trettel
(74) *Attorney, Agent, or Firm*—Edward Langer, Pat. Atty; Shiboleth, Yisraeli, Roberts, Zisman & Co.

(57) ABSTRACT

A method for fitting bedding to a mattress in a fixed, taut position, comprising: providing a side surface formed with an interconnectable fastening means comprising band pairs of a two-sided, hooks-and-loops type material; providing bedding having double bands of fastening means fixedly attached along stretching bands on at least three sides; stretching and drawing a first component of the bedding over the side surface; attaching the first component to the fastening means in a removable attachment; stretching and drawing a second component of the bedding over the side surface; attaching the second component to the mattress fastening means in a removable attachment at a point below that of the first component; and repeating the above steps in sequential order for additional components of the bedding as needed, each additional component being attached in a stepped position extending below the attachment of a prior component on the side surface.

10 Claims, 2 Drawing Sheets

METHOD FOR FITTING BEDDING TO A MATTRESS

FIELD OF THE INVENTION

The present invention relates generally to fitting of bedding to a mattress, and more particularly to a method for fitting bedding to a mattress in a fixed, taut position, while allowing for easy removal and laundering thereof when necessary.

BACKGROUND OF THE INVENTION

The prior art has mainly focused on the functional service of securing bedding, including a mattress cover, to the mattress to provide for healthy and convenient use. To this end, several methods and means were developed that would stabilize the fitting of bedding to a mattress when a person lies (and moves) on the bed and prevent the bedding from slipping off the mattress and thus maintain it more or less in a spread position.

One solution for this problem is the use of specialized mechanical fasteners, such as springs, clamps, and the like, as taught by Reaser in U.S. Pat. No. 4,520,518; Knebel III in U.S. Pat. No. 6,108,837; and Schieberl in U.S. Pat. No. 6,295,670 B1. The disadvantage of such mechanical fasteners is that they are not integral to the bedding system and add unnecessary expense. Furthermore, being specialized, they require extra effort to operate.

Another solution for this problem has been the use of elastic bands sewn or otherwise attached to mattress covers or other bedding, such as fitted sheets, as is taught by J. W. Whitley in U.S. Pat. No. 5,325,555 where an inelastic mattress covering is used with an elastic underskirt, in order to provide the desired fastening of the cover to the mattress. As is well known to those skilled in the art, elastic bands have the disadvantage of losing their elasticity after periods of repeated use and therefore become ineffectual in firmly attaching bedding to mattresses.

Yet another alternative to the problem of securing bedding on mattresses is the use of hook-and-loop fastening means, such as Velcro®, generally in the form of bands or strips sewn or otherwise attached to bedding. For example, Auburn in U.S. Pat. No. 5,490,292 teaches the use of strips of Velcro® material to secure in place various bedding elements, including a cover and a sheet, to a toddler's molded cot. Lepow in U.S. Pat. No. 5,008,966 teaches positioning a bedsheet having an elastic band partially around its perimeter onto a foam sofa bed mattress and fixing it into place with two strips of Velcro® material. These prior art have the disadvantage in the use of Velcro® material in a limited way for simply holding bedding in place. Lepow has the further disadvantage in the use of an elastic band, as mentioned heretofore.

Lewis in U.S. Pat. No. 4,964,184 teaches a "fitted top and bottom bedsheet combination" used with a mattress "to facilitate securement of the top sheet with respect to the mattress" using a Velcro®—covered underportion of the bedding. The top bedsheet has "lateral extensions" which are simply tucked under the mattress to keep it in place, but not necessarily in a fixed or taut position. There are also "gatherings or pleatings" in the material which "facilitate some bunching".

Ainsworth in U.S. Pat. No. 3,965,504 teaches a bedding assembly that stays together comprising bedding "disposed in stacked, non-slip relation and releasably interconnected" through zippers or, alternatively, Velcro® strips to minimize rearranging bedding over the mattress every morning after use. The mattress cover is attached to the mattress by elastic bands or rings at the four corners allowing for some freedom of movement of the mattress cover material and, consequently, ruffling of the interconnected bedding attached to it by the fastening means.

Gilreath in U.S. Pat. No. 4,040,133 teaches a bedding attachment system which uses "a section of Velcro® material . . . positioned on the edge of waterbed mattress adjacent each corner". Gilreath's system provides for holding the bedding to the mattress only on the four corners of the mattress so that there is "relative movement of the mattress and bedding".

Thus there is a need for

- Facilitating the smooth spreading of all bedding items on the mattress in a fixed and taut manner;
- Preventing unwanted separation of bedding items from the mattress;
- Enabling bedding to be fixed in position, and held tautly on a mattress;
- Preventing the need to stretch and fasten the bedding repeatedly;
- Improving the quality of the sleep, on well stretched and tightly set bedding;
- Facilitating the laundering of fitted bedding; and
- Facilitating the orderly folding of bedding items for stowing them away.

SUMMARY OF THE INVENTION

Accordingly, it is a principal object of the present invention to overcome the above disadvantages and drawbacks of the prior art by providing a method for fitting bedding to a mattress in a fixed, taut position, the method comprising:

providing a side surface of a mattress integrally formed with an interconnectable fastening means, wherein the fastening means comprises bands of a two-sided, hooks-and-loops type material, and wherein the outward surface of the side surface exposes a loops side;

providing bedding having double bands of the interconnectable fastening means fixedly attached along stretching bands on at least three sides of the bedding, wherein the double bands comprise adjacent hooks side fastening means and loops side fastening means;

stretching and drawing a first component of the bedding over the side surface of the mattress;

attaching the first component to the fastening means on the mattress in a removable attachment;

stretching and drawing a second component of the bedding over the side surface of the mattress;

attaching the second component to the fastening means on the mattress in a removable attachment at a point below that of the first component; and repeating the stretching, drawing, and attaching steps in sequential order for additional components of the bedding as needed, each additional component being attached in a stepped position extending below the attachment of a prior component of the bedding on the side surface.

The method further comprises the step of folding the bedding so that the pairs of adjacent double bands comprising fastening means are removably attached to each other for laundering and storing the bedding.

The present invention introduces an absolutely new aspect and approach, making a mattress not just an entity unto itself, but rather an integral part of a "sleeping system"

which includes the mattress; a mattress protective cover, if used; at least one bedsheet; at least one blanket; a cushion; and even a bedspread or the like.

Another aspect of the present invention is related to the manner the mattress is viewed when in service—it is suggested that its function is not only to provide a healthy and convenient support to the person lying on it, but also to enable easy, convenient manner for, by way of example, handling the "making of the bed" with the items on it properly held in place at all times.

The present invention relates to both the mattress which is provided with bands of a fastening means, such as Velcro® (manufactured by Velcro USA), formed with or attached to at least three sides, and bedding which is provided with bands of a similar fastening means enabling it to be sequentially attached to the mattress.

As is known to those skilled in the art, bands made of Velcro® have two different surfaces—a loops side and a hooks side which when joined, form a firm, but detachable union.

In a preferred embodiment of the present invention, the side surface of the mattress is covered totally by the fastening means bands, preferably provided as part of the mattress manufacturing process, and made so that the "loops side", which is the soft and more pleasant side when touched, is the one applied facing outwards on the fabricated mattress.

In another preferred embodiment of this invention, the mattress is manufactured as a unit by itself and then the fastening means material is applied on the vertical portions of the periphery, ensuring that the "loops side" is facing outwards.

In a preferred embodiment of the present invention, the bedding incorporates a protective mattress cover, wherein along at least three sides of its periphery there are fastening means bands that, after it is properly laid and stretched, enable it to be attached flush to the mattress preventing the mattress cover from separating (being non-intentionally removed) from the mattress.

Similarly, the sleeping system includes a bedsheet having extended portions made in accordance with a preferred embodiment of the invention. It has lengthwise dimensions which are larger than those of the protective mattress cover and is also equipped with fastening means bands so that it stays put once spread above the matress cover and fastened to the exposed peripheral surfaces of the mattress where there are protruding fastening means.

By preferably the same manufacturing principle and implementation, additional items on top (such as a blanket) are secured in the same manner.

Obviously, the dimensions of the extended portions of the bedsheet are preferably somewhat larger than those of the protective mattress cover.

The present invention relies on using pairs of the two different sides of the bands. Preferably, these pairs would be sewed upon the sheets so that they would provide the coupling between bedsheets and mattress.

In addition, these pairs would enable one to cover the "hooks side" of the fastening means, so that other items in the laundry would not be caught or tangled up with them by the "hooks side" of the fastening means.

In a preferred embodiment of the present invention, the mattresses endowed with the attachable side surfaces as disclosed above, are manufactured in a uniform production process. However, such fastening means may also be sewed, glued, and the like, on the mattresses' side surfaces, preferably at the end of the production process.

BRIEF DESCRIPTION OF THE DRAWINGS

For a better understanding of the invention in regard to the embodiments thereof, reference is made to the accompanying drawings (not to scale) and description, in which like numerals designate corresponding elements or sections throughout, and in which.

DETAILED DESCRIPTION OF THE PREFERRED EMBODIMENTS

The invention will now be described in connection with certain preferred embodiments with reference to the prior referenced, illustrative figures so that it may be more fully understood.

Figure 1:
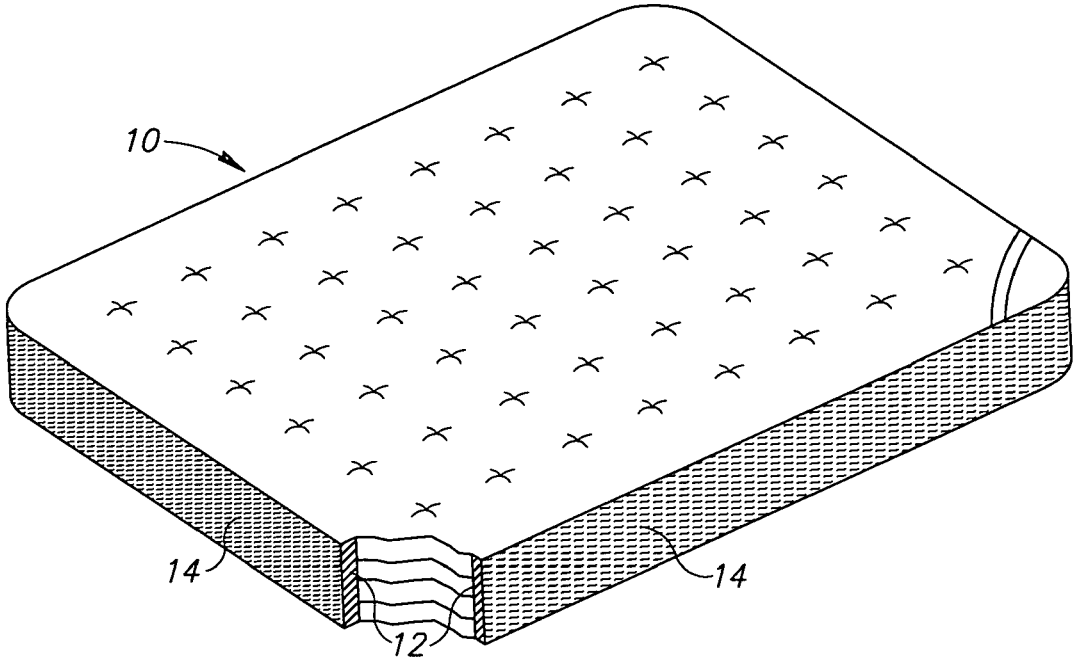
FIG. 1 illustrates a perspective view of a mattress provided with a loops-and-hooks fastening means along the sides thereof.

Referring now to FIG. 1, there is shown a perspective view of a mattress provided with a loops-and-hooks interconnectable fastening means along the sides thereof in accordance with a preferred embodiment of the invention. Side surfaces 12 of mattress 10 are provided with a fastening means 14 (see cut-away), such as Velcro® (trademark of Velcro USA) manufactured integrally with the production of mattress 10 so as to envelop all the vertical surface areas of side surfaces 12. Generally, the material comprising fastening means 14 has preferably two different sides, namely the "hooks side" and the "loops side" made to interconnect one with the other. In FIG. 1, the "loops side" of fastening means 14 covering side surfaces 12 faces outwards so as to provide a pleasant and smooth texture to human touch and serve as a hold for the corresponding "hooks side" of fastening means 14 applied in bands or strips to bedding elements (see FIG. 2).

Figure 2:
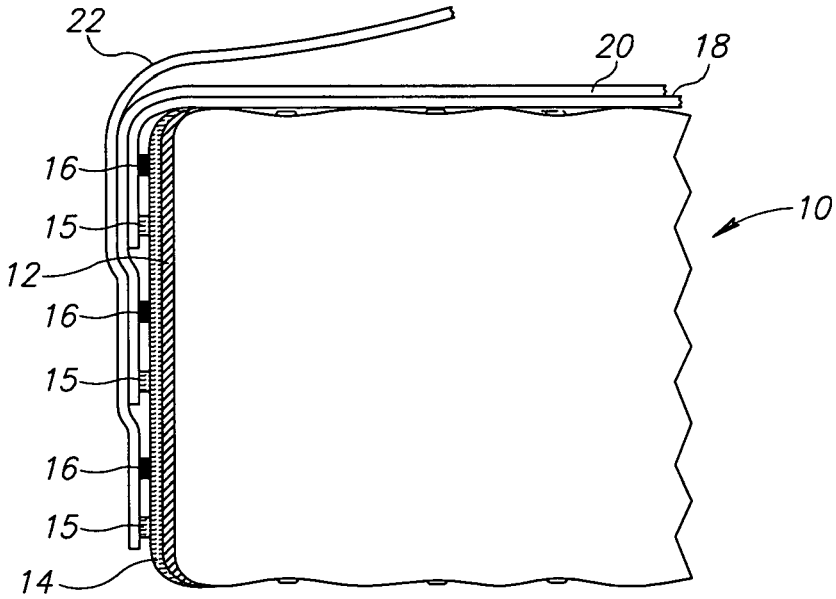
FIG. 2 shows a cross-section, end view of the mattress shown in FIG. 1, illustrating a preferred method of the invention for removably attaching bedding to a mattress whose side surface is provided with a fastening means.

FIG. 2 shows a cross-section, end view of the mattress shown in FIG. 1, illustrating a preferred method of the invention for removably attaching bedding to a mattress whose side surface is provided with a fastening means. Fastening means 14 on side surfaces 12 enables stretching and securing to it, sequentially, all bedding items generally used with a mattress, so that items attached thereto remain well stretched and prevented from separating (being detached) from the side surfaces 12 and neither lifted up from it nor getting crumpled on it.

Bedding shown attached to mattress 10, by way of example, comprises a protective mattress cover 18, a bedsheet 20, and a blanket 22. Preferably, fastening means 14 along the sides 12 of mattress 10 enables other matching bedding items to be sequentially put over the mattress cover 18 and secured to mattress 10, because the fastening means 14 is exposed and extends beyond the edge of mattress cover 18.

Fastening means 14 is fixedly attached to the edges of each item comprising the bedding in paired bands of loops 15 and hooks 16. Adjacent to each "hooks side" band 16 there lies "loops side" bands 15 serving to cover the "hooks side" 16 for laundering and storing the bedding, without becoming snagged or entangled in the process due to the nature of the materials comprising the fastening means. The hooks 16 are removably attached to fastening means 14 of side surface 12 whereas the bands comprising loops 15 do not interconnect with fastening means 14 since they are not interconnectablely paired.

Figure 3A:
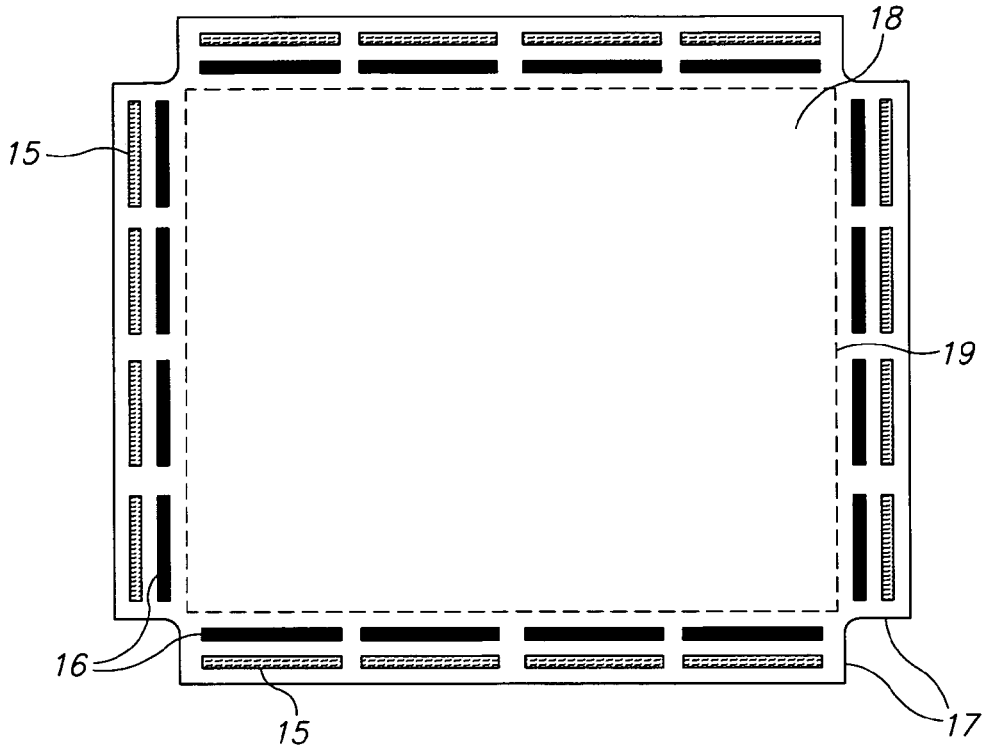
FIG. 3A presents a spread view of a protective mattress cover provided with short stretching bands along its periphery on four sides in accordance with another embodiment of the invention.

FIG. 3A presents a spread, underside view of a protective mattress cover provided with short stretching bands along its periphery on four sides in accordance with a preferred embodiment of the invention.

Mattress cover 18 is shown in an underside view so that four stretching bands 17 are exposed together with bands of fastening means—both "loops side" 15 and "hooks side"16 fixedly attached thereon. The broken line 19 represents the outline of a typical mattress (not visible).

Figure 3B:
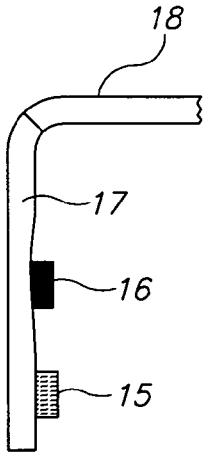
FIG. 3B is a detailed, partial cross-section view of a typical stretching band of the mattress cover shown in FIG. 3A showing a pair of interconnectable fastening means fixedly attached thereto in an unfolded, draped position.

FIG. 3B is a detailed, partial cross-section view of a typical stretching band of the mattress cover shown in FIG. 3A showing an interconnectable pair of fastening means fixedly attached thereon in an unfolded, draped position. Along each stretching band 17 there are sections of double fastening means bands, the "loops side" 15 and the "hooks side" 16, respectively. The hooks band 16 is used to secure the mattress cover 18 to the mattress 10 and keeps the cover 18 tight to the mattress 10. The loops band 15 is used to cover the hooks band 16 to enable laundering without being snagged with other items being laundered. The unfolded position enables removable attachment of hooks band 16 on various types of bedding to fastening means 14 on side surfaces 12 of a mattress (show in dashed outline 19). The streching bands 17 are used to srtech the mattress cover 18 over the mattress 10 and fix it to the side surfaces 12.

Figure 3C:
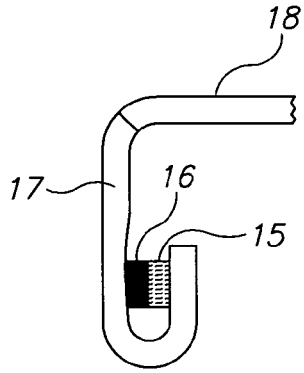
FIG. 3C is a detailed, partial cross-section view of the stretching band of FIG. 3B showing the cover fabric folded over so as to join the pair of fastening means to facilitate easy laundering of the mattress cover.

FIG. 3C is a detailed, partial cross-section view of the stretching band of FIG. 3B showing the stretching band 17 of the mattress cover 18 folded over so as to join the pair of fastening means 15, 16 to each other to facilitate easy laundering of mattress cover 18.

It is specifically noted that although the present invention and its background are presented with reference to an application of fastening bedding (such as mattress covers, sheets, blankets, and the like) to a mattress, anyone skilled in the art would understand that the invention is not restricted solely to fastening applications of certain bedding items as cited, but rather it can be applied also for attachment of other items such as continental quilts, ornamental bedspreads or protective covers for sofa surfaces to guard against dust or the dirty shoes of sprawling kids.

Having described the present invention with regard to certain specific embodiments thereof, it is to be understood that the description is not meant as a limitation, since further modifications will now suggest themselves to those skilled in the art, and it is intended to cover such modifications as fall within the scope of the appended claims.

I claim:

1. A method for fitting bedding to a mattress in a fixed, taut position, said method comprising:

providing a side surface of a mattress integrally formed with an interconnectable fastening means, wherein said fastening means comprises pairs of interconnectable bands of a two-sided, hooks-and-loops type material, and wherein the outward surface of said side surface exposes a loops side;

providing bedding having double bands of said interconnectable fastening means fixedly attached along stretching bands on at least three sides of said bedding, wherein said double bands comprise adjacent hooks side fastening means and loops side fastening means;

stretching and drawing a first component of said bedding over said side surface of said mattress;

attaching said first component to said fastening means on said mattress in a removable attachment;

stretching and drawing a second component of said bedding over said side surface of said mattress;

attaching said second component to said fastening means on said mattress in a removable attachment at a point below that of said first component; and repeating said stretching, drawing, and attaching steps in sequential order for additional components of said bedding as needed, each additional component being attached in a stepped position extending below the attachment of a prior component of said bedding on said side surface.

2. The method of claim 1 further comprising the step of folding said bedding so that said pairs of adjacent double bands comprising fastening means provided thereon are removably attached to each other for laundering and storing said bedding.

3. The method of claim 1 wherein said double bands comprise pairs of at least one strip each of hooks bands and loops bands.

4. The method of claim 1 wherein said first component, said second component, and said additional components comprise bedding selected from at least one of the group: mattress cover, lower bedsheet, upper bedsheet, blanket, top cover, and bedspread.

5. The method of claim 4 wherein said bedding is provided with a plurality of fastening means sewed in pairs of rows along the periphery of stretching bands of said bedding so as to be removably attachable to said side surface.

6. The method of claim 1 wherein said side surface comprises fastening means material formed as an attachment to a mattress after its production.

7. The method of claim 1 wherein said side surface comprises integral stretching bands.

8. The method of claim 1 wherein said side surface comprises connected, non-integral stretching bands provided with bands of fastening means formed along their length.

9. The method of claim 1 wherein said bedding is made from at least one of rubber and integral stretching bands provided with pairs of fastening means.

10. The method of claim 4 wherein said bedding is provided with a plurality of fastening means sewed in pairs of rows along the periphery of stretching bands of said bedding so as to be removably attachable to said at least three sides of its peripheral surfaces.

* * * * *